US005699675A

United States Patent [19]

Nagai et al.

[11] Patent Number: 5,699,675

[45] Date of Patent: Dec. 23, 1997

[54] HEAT EXCHANGER AND COOLING APPARATUS MOUNTED WITH THE SAME

[75] Inventors: Toshitake Nagai; Yonezo Ikumi; Takahide Kakinuma; Norio Sawada; Koji Sato; Masato Watanabe, all of Gunma-ken, Japan

[73] Assignee: Sanyo Electric Co., Ltd., Osaka, Japan

[21] Appl. No.: 494,026

[22] Filed: Jun. 23, 1995

[30] Foreign Application Priority Data

Sep. 16, 1994 [JP] Japan ..... 6-248599
Nov. 14, 1994 [JP] Japan ..... 6-304299

[51] Int. Cl.[6] ..... F25B 45/00

[52] U.S. Cl. ..... 62/149; 62/125; 62/292; 62/525; 165/177; 165/150

[58] Field of Search ..... 62/524, 525, 292, 62/149, 125, 126, 502, 114; 165/150, 177

[56] References Cited

U.S. PATENT DOCUMENTS 2,102,807 12/1937 Witzel ..... 62/525
2,626,130 1/1953 Raskin ..... 165/177
4,149,390 4/1979 Iijima et al. ..... 62/525

FOREIGN PATENT DOCUMENTS 58-11396 1/1983 Japan ..... 165/150
60-26301 8/1985 Japan .
60-26303 8/1985 Japan .

*Primary Examiner*—John M. Sollecito
*Attorney, Agent, or Firm*—Darby & Darby

[57] ABSTRACT

An object of the invention is to settle an unbalanced refrigerant flow in a heat exchanger thereby to improve a heat exchanging efficiency. In a heat exchanger having a refrigerant conduit provided through a plurality of fins, the refrigerant conduit is divided into a plurality of sets, each consisting of a plurality of parallel conduits, and parallel conduits of a set are put in communication with each other at ends thereof and in communication, through a single passage, with ends of parallel conduits of another set.

6 Claims, 9 Drawing Sheets

HEAT EXCHANGER AND COOLING APPARATUS MOUNTED WITH THE SAME

BACKGROUND OF THE INVENTION

The present invention relates to heat exchangers for refrigeration or air-conditioning use in which a refrigerant conduit is provided through a plurality of fins, and to cooling apparatus mounted with the same such as refrigerators and air conditioners.

In conventional heat exchangers used as an evaporator or condenser for use in refrigeration or air-conditioning, as disclosed for example in Japanese Utility Model Registration Application Laid-open Publication Nos. 26301/1985 (F28F1/32) and 26303/1985 (F28F1/32), a plurality of fins are arranged at predetermined spaces, a plurality of refrigerant conduits are provided through the fins, and each refrigerant conduit is put in communication with another refrigerant conduit through a bent connection conduit attached to their ends. Thus, a meandering refrigerant passage is formed.

Furthermore, according to the conventional practice with this kind of heat exchangers, in order to reduce a passage resistance for the refrigerant passing through the refrigerant conduit or for the purpose of improving the heat exchanging efficiency and space efficiency, the refrigerant conduit branches off at an inlet to be a plurality of parallel conduits, and the parallel conduits join again at an outlet.

FIGS. 10 and 11 show conduit arrangement examples of a conventional heat exchanger 100. In actuality, refrigerant conduits 101, 102, and 107 of FIGS. 10 and 11 form a meandering refrigerant passage by connecting a plurality of refrigerant conduits and connection conduits as described above. However, for convenience of explanation, the refrigerant conduits are represented with a long linear conduit.

That is, the heat exchanger 100 of FIG. 10 comprises a plurality of fins 103 arranged at predetermined spaces and two refrigerant conduits 101, 102, for example, provided through the fins 103. A dividing conduit 104 is connected to ends of both refrigerant conduits 101, 102 on the inlet side of the heat exchanger 100. A joining conduit 106 is connected to other ends of both refrigerant conduits 101, 102 on the outlet side of the heat exchanger 100.

The heat exchanger 100 is installed in a refrigerant circuit (not shown). When a compressor (not shown) is operated, the refrigerant enters the heat exchanger 100 as indicated by an arrow in the figure. The entering refrigerant is divided into two streams by the dividing conduit 104. The divided refrigerant passes through the refrigerant conduits 101, 102. While passing through the conduits, the refrigerant radiates heat (when the heat exchanger 100 is used as a condenser) or absorbs heat (when used as an evaporator). Then, the two streams of refrigerant are joined through the joining conduit 106 before leaving the heat exchanger 100.

FIG. 11 shows another example of conduit arrangement of the conventional heat exchanger 100. In this case, the refrigerant conduits 101, 102 are somewhat shorter than those in FIG. 10. Furthermore, one refrigerant conduit 107 fitted with fins 103 is connected to the outlet of the joining conduit 106.

However, in normal operation, the division of a refrigerant flow and the ratio between liquid (refrigerant in a liquid state) and gas (refrigerant in a gaseous state) are likely to become unbalanced between the refrigerant conduits 101 and 102 due to a difference in passage resistance between the refrigerant conduits 101, 102 and a nonuniform exposure of the heat exchanger 100 to air flow. This unbalance is more noticeable with an evaporator which involves a higher pressure loss.

Particularly, in recent years, since dichlorodifluoromethane (R12) and monochlorodifluoromethane (R22) which has been used conventionally and widely in refrigeration and air-conditioning fields is subject to the flon regulations to cope with damage to the ozone layer, the use of mixed HFC (hydrofluorocarbon) refrigerants including 1,1,1,2-tetrafluoroethene (hereinafter referred to as R134*a*) as a substitutive refrigerant is considered. Mixed HFC refrigerants include, for example, a triple mixed refrigerant prepared by mixing R134*a*, difluoromethane (hereinafter referred to as R32), and pentafluoroethane (hereinafter referred to as R125) at predetermined proportions (refer to Japanese Patent Application Laid-open No. 170585/1991 for example). However, even when such a non-azeotropic mixed refrigerant of multiple kinds of refrigerants having different boiling points is used, the above-mentioned unbalance is still likely to occur.

When an unbalanced refrigerant flow or liquid-gas ratio causes the refrigerant to hardly flow through either refrigerant conduit 101 or 102, the heat exchanger 100 functions only by half. That is, the heat exchanger 100 cannot be utilized effectively as a whole. This leads to a deterioration in heat exchanging efficiency and a drop in cooling capability.

A conceivable measure to this problem is to put both refrigerant conduits 101, 102 in communication with each other at mid portions thereof through an equalizing conduit thereby to establish a pressure balance. However, since the refrigerant hardly flows through the equalizing conduit, an unbalanced refrigerant flow still remains unsolved.

A drop in cooling capability also occurs as a result of a refrigerant leak from a refrigerant circuit over a long period of operation. In particular, when the above-mentioned non-azeotropic mixed refrigerant is used, a refrigerant leak causes a change in the total refrigerant quantity contained in the refrigerant circuit and a deviation of refrigerant composition (proportions of ingredient refrigerants) from a best value. Furthermore, the refrigerant composition becomes unbalanced also within the refrigerant circuit, thus causing a noticeable deterioration in cooling capability.

SUMMARY OF THE INVENTION

An object of the present invention is to prevent a deterioration in cooling capability caused by an unbalanced refrigerant flow or liquid-gas ratio or by a change in a refrigerant state represented by a change in total refrigerant quantity or refrigerant composition.

A heat exchanger according to the present invention has a refrigerant conduit provided through a plurality of fins. The refrigerant conduit is divided into a plurality of sets, each consisting of a plurality of parallel conduits. Parallel conduits of a set are put in communication with each other at ends thereof and in communication, through a single passage, with ends of parallel conduits of another set.

In this construction, even when a refrigerant flow becomes unbalanced among parallel conduits of a certain set, it will be settled as follows. Since refrigerant streams leaving the set join once before entering the next set, an unbalance of a refrigerant flow or of a liquid-gas ratio is settled at the junction of the streams. Accordingly, an unbalance of a refrigerant flow or the like is less likely to occur in the heat exchanger as a whole. This allows the heat exchanger to fully exhibit its performance with a resultant improvement of heat exchanging efficiency and cooling capability.

Also, a cooling apparatus according to the present invention contains within a refrigerant circuit thereof a mixture refrigerant of a plurality of hydrofluorocarbon refrigerants not including chlorine. The cooling apparatus has a refrigerant density detector, which comprises a sonic velocity measuring device for measuring a sonic velocity of the mixed refrigerant, a thermometer for measuring a temperature of the mixed refrigerant, and a pressure gauge for measuring a pressure of the mixed refrigerant, a refrigerant charge block provided in the piping of the refrigerant circuit, a plurality of tanks of different kinds connected to the refrigerant charge block via control valves, and a controller for controlling the opening and closing of the control valves. The refrigerant density detector detects the density of the mixed refrigerant in the refrigerant circuit. The controller is adapted to charge the refrigerant circuit with a required kind of refrigerant by a required quantity from the refrigerant tanks.

In the cooling apparatus, even when a mixed refrigerant of R134*a* and R32 for example is used, the refrigerant density detector can determine which refrigerant has leaked by what quantity. That is, the kind and quantity of a refrigerant to be additionally charged can be automatically determined, and thus identified refrigerant can be automatically added by a required quantity from a relevant refrigerant tank. Also, since the kind and quantity of a refrigerant to be additionally charged can be accurately determined, it is possible to adjust the composition of the mixed refrigerant to the one at the initial charge. Thus, a good cooling capability can be maintained.

As a result, a work efficiency of additional charge, maintenance and the like can be improved, and a required cooling performance can be secured.

DETAILED DESCRIPTION OF THE PREFERRED EMBODIMENTS

Embodiments of the present invention will now be described with reference to the drawings.

Figure 1:
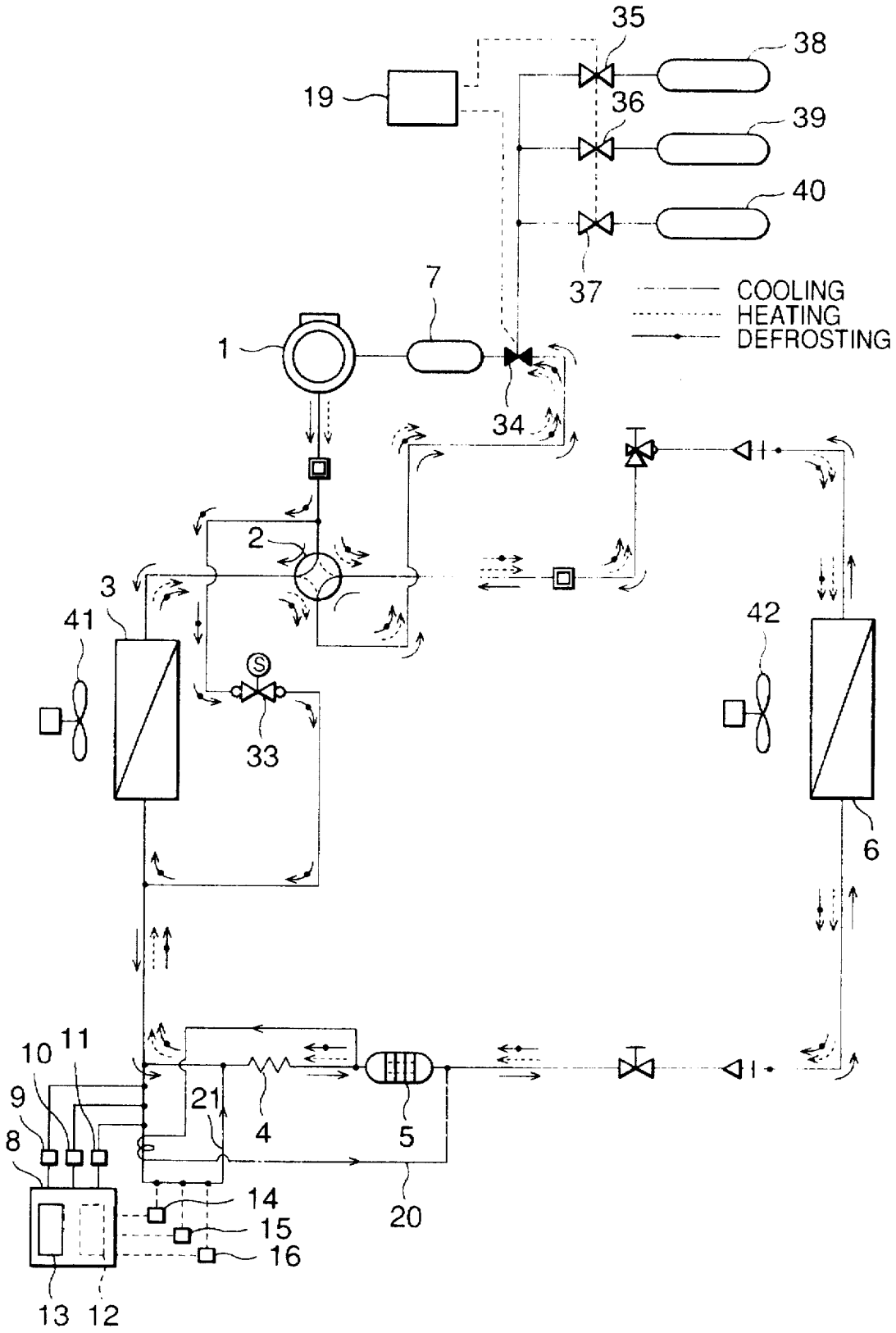
FIG. 1 is a refrigerant circuit diagram of an air conditioner showing a cooling apparatus according to an embodiment of the present invention.

In FIG. 1, an air conditioner as a cooling apparatus according to an embodiment of the present invention comprises a compressor 1, a four-way valve 2, an outdoor heat exchanger 3, a capillary tube 4 as a pressure reducing device, a strainer 5, an indoor heat exchanger 6, and an accumulator 7, which components are connected by piping. Also, the air conditioner is charged with a mixed refrigerant including HFC refrigerants and with an oil compatible with the mixed refrigerant. Furthermore, fans 41, 42 are provided to generate a current of air for blowing the outdoor heat exchanger 3 and the indoor heat exchanger 6, respectively.

Polyol ester oil is stored in the refrigerant circuit. Sliding surfaces of sliding members of the compressor 1 are lubricated with the oil. The oil may be alkylbenzene oil, for example, HAB (hard alkylbenzene), or fluoro-oil or mineral oil or mixture thereof.

A refrigerant and an oil to be charged into the refrigerant circuit depends on an evaporation temperature, i.e. application. For example, for high-temperature equipment such as the air conditioner of the present embodiment, a refrigerant to be used is a mixed HFC refrigerant including R134*a*, for example, a triple mixed refrigerant of R134*a*, R32, and R125, and an oil to be used is a polyol ester oil or alkylbenzene oil.

The indoor heat exchanger 6 comprises a plurality of fins 23 arranged at predetermined spaces and a refrigerant conduit 24 provided through the fins 23. Furthermore, the refrigerant conduit 24 is divided into a plurality of sets S1, S2, and S3 (three sets in the present embodiment), each consisting of two parallel conduits 26, 27 for example.

Figure 4:
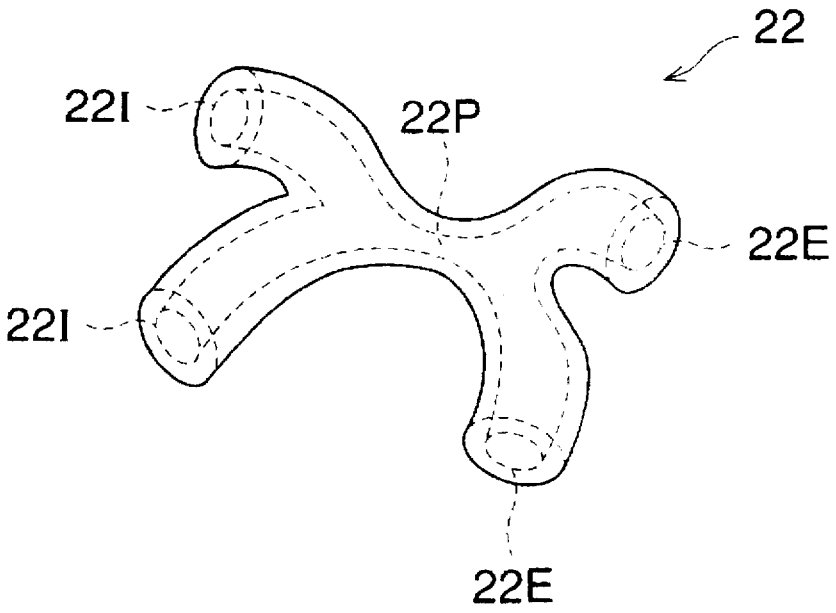
FIG. 4 is a perspective view showing a connection conduit.

A connection conduit 22 is installed between sets S1 S2, and S3 to connect them in series. As shown in FIG. 4, the connection conduit 22 has, for example, two inlets 22I, 22I and two outlets 22E, 22E and a single passage 22P to allow the inlets 22I, 22I and the outlets 22E, 22E to communicate with each other. An inner diameter of the passage 22P is rendered smaller than that of the conduits 26, 27.

Ends of the constituent parallel conduits 26, 27 of set S1 are connected to the inlets 22I, 22I of the connection conduit 22, respectively, for mutual communication. Outlets 22E, 22E are connected to ends of the constituent parallel conduits 26, 27 of set S2, respectively, for mutual communication. Likewise, other ends of the constituent parallel conduits 26, 27 of set S2 are connected to the inlets 22I, 22I of the connection conduit 22, respectively, for mutual communication. Outlets 22E, 22E are connected to ends of the constituent parallel conduits 26, 27 of set S3, respectively, for mutual communication. Also, a dividing conduit 31 as described previously is connected to other ends of the constituent parallel conduits 26, 27 of set S1, and a joining conduit 32 is connected to other ends of the constituent parallel conduits 26, 27 of set S3.

Thus, the parallel conduits 26, 27 of sets S1–S3 are connected in parallel arrangement. Furthermore, sets S1 and S2 communicate with each other, and sets S2 and S3 communicate with each other, through a single passage 22P of the connection conduit 22 connected therebetween, respectively.

Figure 2:
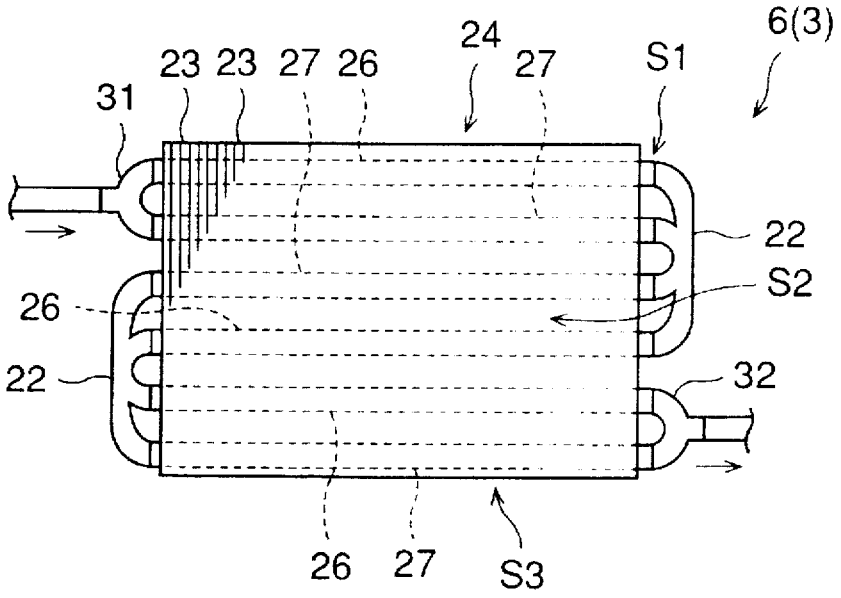
FIG. 2 is a front view of an indoor heat exchanger (outdoor heat exchanger) showing a heat exchanger of the present invention.
Figure 3:
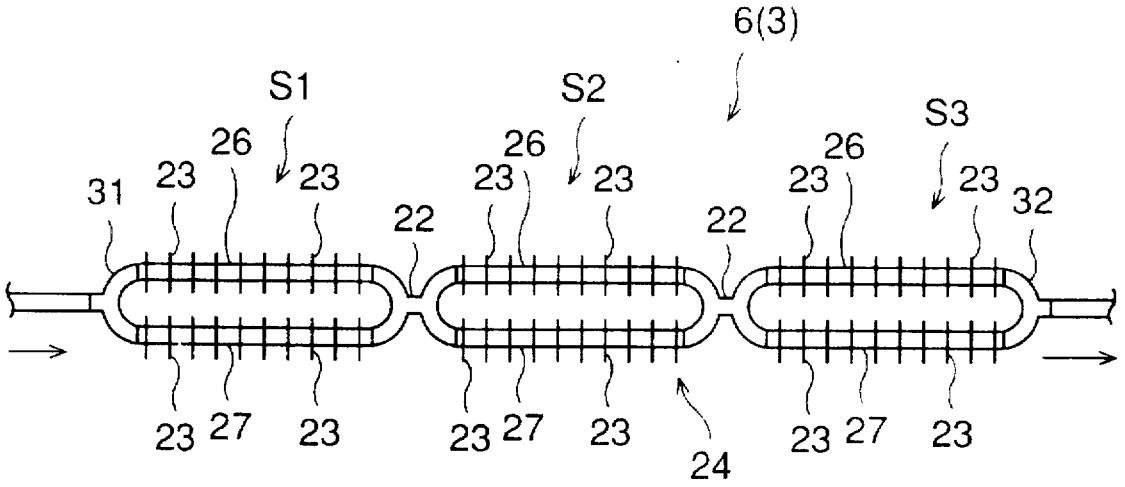
FIG. 3 is a view showing the conduit arrangement of the indoor heat exchanger (outdoor heat exchanger) of FIG. 2.

The outdoor heat exchanger 3 is similar in structure to the indoor heat exchanger shown in FIGS. 2 and 3, and hence the description thereof is omitted.

In the above construction, when the air conditioner performs a cooling operation, the mixed refrigerant flows, as indicated by arrows of a solid line in FIG. 1, in the order of the compressor 1, the four-way valve 2, the outdoor heat exchanger 3, the capillary tube 4, the strainer 5, the indoor heat exchanger 6, and the accumulator 7. The cold air generated by a heat exchange with the indoor heat exchanger 6 is supplied to a room in the form of a cold wind by the fan 42. In this case, the indoor heat exchanger 6 functions as an evaporator, and the outdoor heat exchanger 3 functions as a condenser.

In a heating operation, the mixed refrigerant flows, as indicated by arrows of a dashed line in FIG. 1, in the order of the compressor 1, the four-way valve 2, the indoor heat exchanger 6, the strainer 5, the capillary tube 4, the outdoor heat exchanger 3, and the accumulator 7. The warm air generated by a heat exchange with the indoor heat exchanger 6 is supplied to a room in the form of a warm wind by the fan 42. In this case, the indoor heat exchanger 6 functions as a condenser, and the outdoor heat exchanger 3 functions as an evaporator.

In a defrosting operation, the mixed refrigerant flows, as indicated by arrows of a solid line with a midpoint in FIG. 1, in the order of the compressor 1, the four-way valve 2, the indoor heat exchanger 6, the strainer 5, the capillary tube 4, the outdoor heat exchanger 3, the four-way valve 2, and the accumulator 7. Also, the mixed refrigerant flows through the compressor 1, the solenoid valve 33, and the outdoor heat exchanger 3 to defrost the outdoor heat exchanger 3.

In the above-mentioned cooling operation, the mixed refrigerant discharged from the compressor 1 is condensed at the outdoor heat exchanger 3 and then is pressure reduced at the capillary tube 4 to enter a two-phase state. Then, the mixed refrigerant in the two-phase state enters the indoor heat exchanger 6, as indicated by an arrow in FIG. 3. The refrigerant (mixed refrigerant) entering the indoor heat exchanger 6 is divided in half by the dividing conduit 31 before entering the parallel conduits 26, 27 of set S1. In set S1, R32 and R125 having a lower boiling point in the refrigerant begin to evaporate, thereby performing a heat absorbing operation (cooling operation).

Refrigerant streams having passed through the parallel conduits 26, 27 of set S1 join once, and then the refrigerant is divided again in half before entering the parallel conduits 26, 27 of set S2. Refrigerant streams having passed through the parallel conduits 26, 27 of set S2 join again, and then the refrigerant is divided again in half before entering the parallel conduits 26, 27 of set S3. Refrigerant streams having passed through the parallel conduits 26, 27 of set S3 (R134*a* begins to evaporate at this point of time) pass through the joining conduit 32 to join, and then the refrigerant leaves the indoor heat exchanger 6.

The state of the refrigerant flowing through the indoor heat exchanger 6 will now be described. In the proximity of the inlet of the heat exchanger 6, the gas of R32 and R125 having a lower boiling point assumes a larger proportion. In the proximity of the outlet, the gas of R134*a* assumes a larger proportion. Also, the refrigerant flowing through the indoor heat exchanger 6 is throttled when passing through the passage 22P of the connection conduit 22.

Here, the above-mentioned non-azeotropic mixed refrigerant is used. Thus, because of a one-sided flow of wind generated by the fan 42 around the indoor heat exchanger 6 and for other relevant reasons, the refrigerant is not equally divided for the parallel conduits 26, 27 in each set S1, S2, S3. That is, a refrigerant flow and a liquid-gas ratio are likely to become unbalanced between the parallel conduits 26, 27.

However, in the present invention, even when a refrigerant flow becomes unbalanced between the parallel conduits 26, 27 of set S1 for example, refrigerant streams having left set S1 join once through the connection conduit 22 before entering set S2. Accordingly, the unbalanced refrigerant flow and liquid-gas ratio in set S1 is settled when refrigerant streams mix with each other in the passage 22P of the connection conduit 22. Thus, an unbalance of a refrigerant flow and the like is less likely to occur in all sets S1–S3 of the indoor heat exchanger 6. As a result, the indoor heat exchanger 6 fully exhibits its performance with a resultant improvement of a heat exchanging efficiency. This has been tested by experiment.

Figure 10:
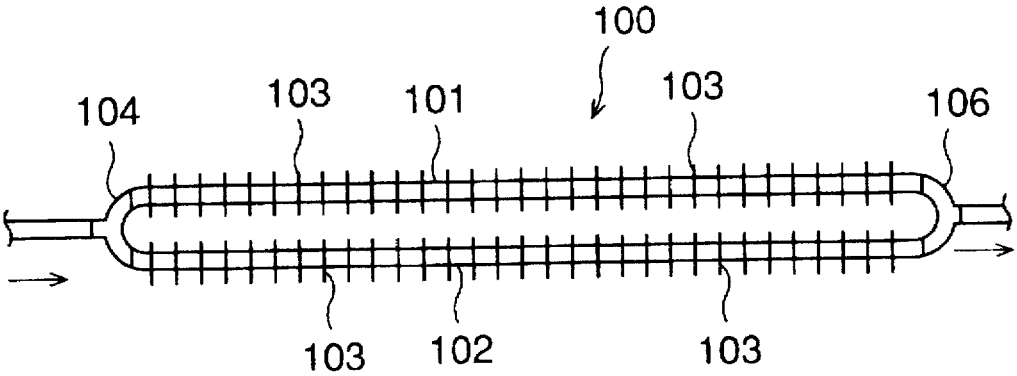
FIG. 10 is a view showing a conduit arrangement of a conventional heat exchanger.
Figure 11:
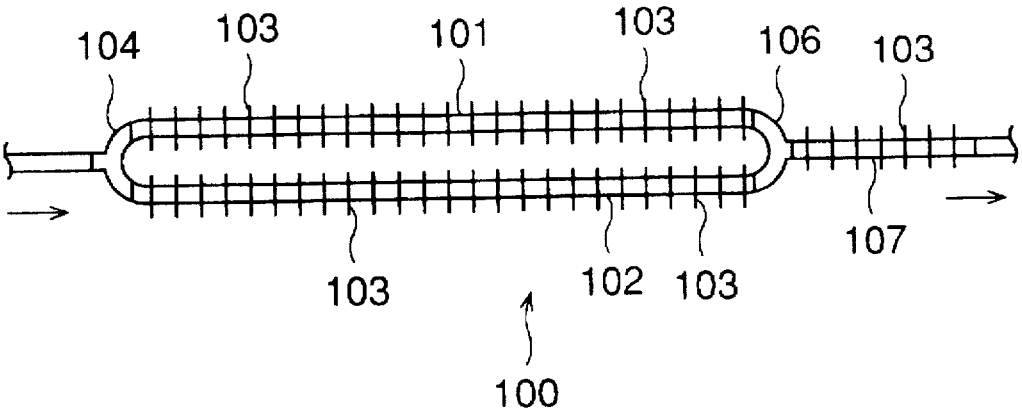
FIG. 11 is a view showing another conduit arrangement of the conventional heat exchanger.
Figure 12:
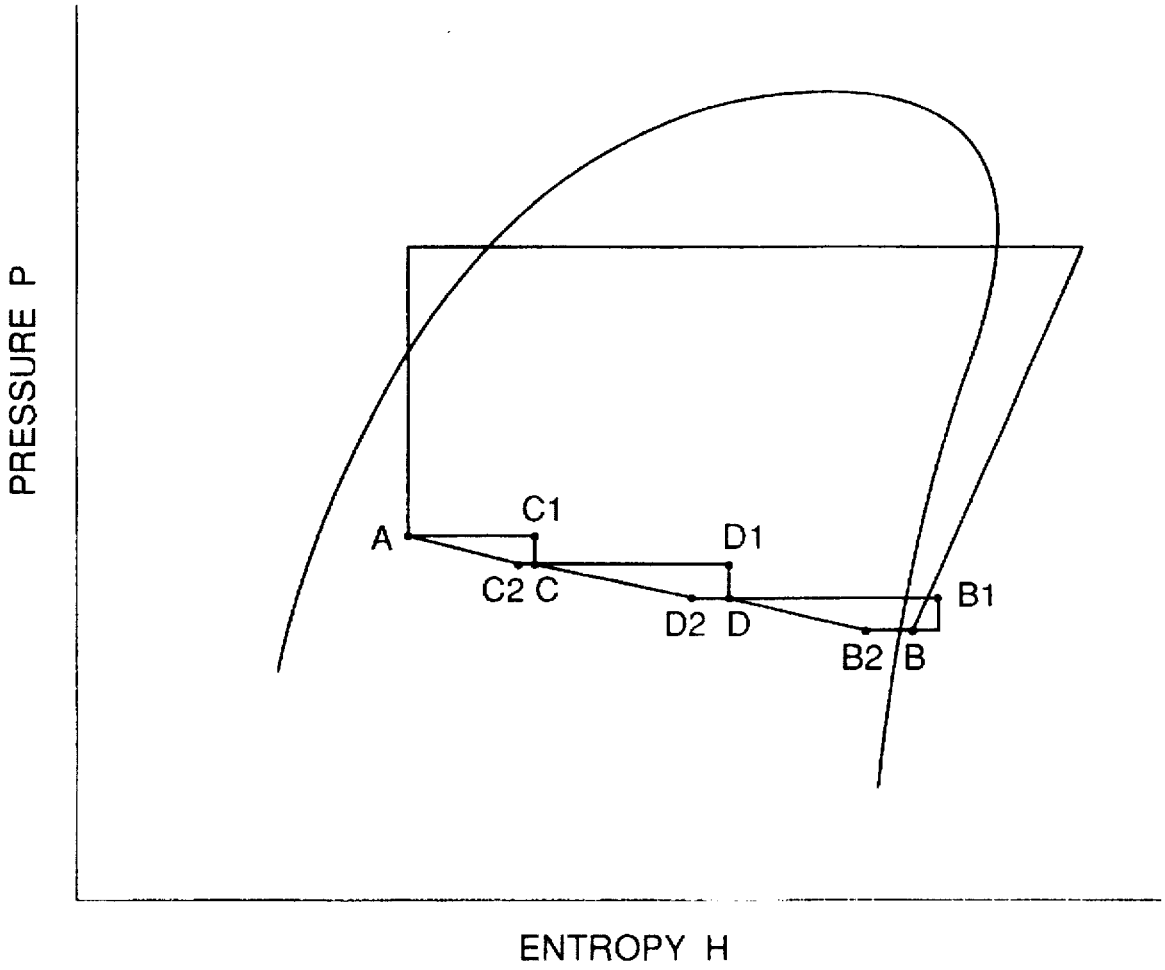
FIG. 12 is a Mollier diagram of the indoor heat exchanger of FIG. 3.
Figure 13:
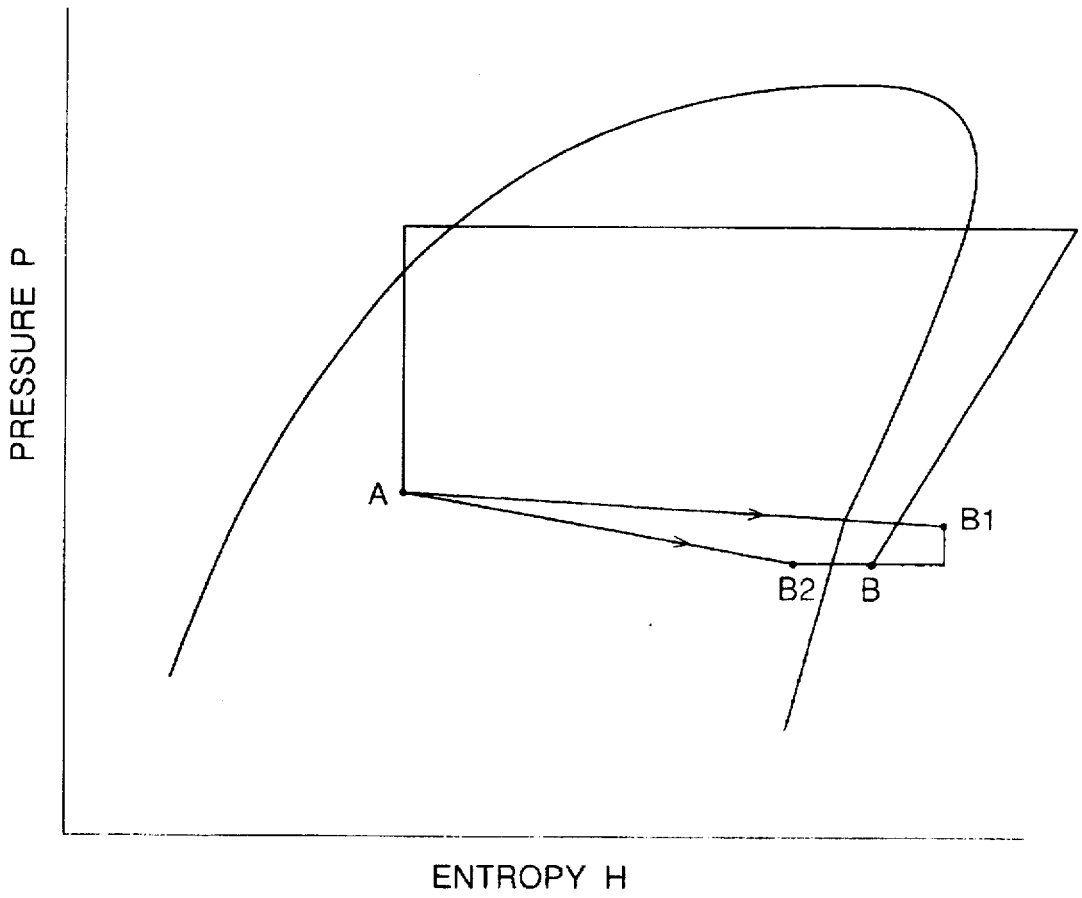
FIG. 13 is a Mollier diagram of the conventional heat exchanger of FIG. 10.

This mechanism will now be described with reference to FIGS. 12 and 13. FIG. 12 is a Mollier diagram of the indoor heat exchanger 6 of FIG. 3. FIG. 13 is a Mollier diagram of the conventional heat exchanger 100 of FIG. 10. For the conventional heat exchanger 100, as seen from FIG. 13, when a refrigerant flow of the refrigerant conduit 101 becomes greater than that of the refrigerant conduit 102, a pressure change within the refrigerant conduit 101 follows line A-B1. This indicates that a refrigerant pressure in the refrigerant conduit 101 becomes greater than that in the refrigerant conduit 102 represented by line A-B2. Then, the refrigerant pressure becomes B at the junction of the refrigerant streams.

By contrast, when an unbalance of a refrigerant flow as above arises between the parallel conduits 26, 27 of each set S1–S3 of the indoor heat exchanger 6 (a flow in the conduit 27 becomes greater than that in the conduit 26), a pressure change within the conduit 26 of set S1 follows line A-C1, and a pressure change within the conduit 27 follows line A-C2. The refrigerant streams join at the connection conduit 22 to become C in pressure. Also, a pressure change within the conduit 26 of set S2 follows line C-D1, and a pressure change within the conduit 27 follows line C-D2. Then, the refrigerant streams join at the connection conduit 22 to become D in pressure. Furthermore, a pressure change within the conduit 26 of set S3 follows line D-B1, and a pressure change within the conduit 27 follows line D-B2. Then, the refrigerant streams join at the connection conduit 22 to become B in pressure.

That is, a pressure of the conduit 26 is reduced and thus corrected at each connection pipe 22. As a result, a pressure of the conduit 26 having a smaller flow is reduced in each set S1–S3, thereby making it possible to also reduce a temperature. Thus, the heat exchanging efficiency of the indoor heat exchanger 6 improves.

In particular, since the refrigerant is throttled by the passage 22P of the connection conduit 22, a temperature difference can be reduced between the inlet and outlet of the indoor heat exchanger 6. This makes it possible to suppress or prevent the occurrence of frosting at the inlet.

Figure 5:
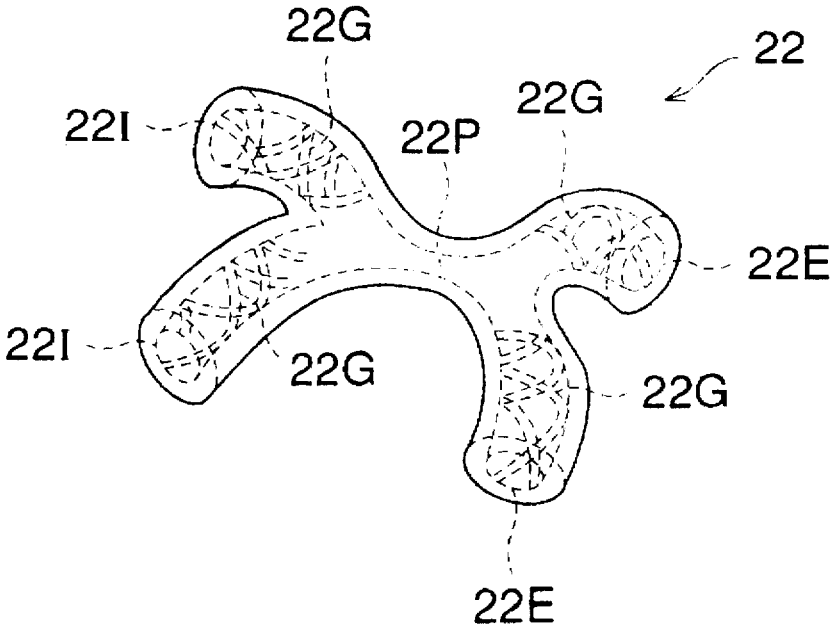
FIG. 5 is a perspective view sowing a connection conduit according to another embodiment.

FIG. 5 shows the connection conduit 22 according to another embodiment. In this case, one or a plurality of spiral projections 22G having a predetermined height (0.1–0.2 mm) are formed on the inner surface of the connection conduit 22 in an area extending from the two inlets 22I, 22I to the proximity of the passage 22P and in an area extending from the proximity of the passage 22P to the two outlets 22E, 22E. The spiral projection 22G causes the refrigerant which enters the connection conduit 22, passes through the passage 22P, and then flows out therefrom, to flow in vortex. Accordingly, refrigerant streams from the parallel conduits 26, 27 mix smoothly and well, thereby solving the above-mentioned unbalance more effectively.

Next, reference numeral 8 denotes a refrigerant density detector. The refrigerant density detector 8 comprises sonic velocity measuring devices 9, 14 for measuring a sonic velocity of the mixed refrigerant of R134*a*, R32, and R125 in the liquid zone between the outdoor heat exchanger 3 and the capillary tube 4 by ultrasonic means, thermometers 10, 15 for measuring a temperature of the mixed refrigerant, and pressure gauges 11, 16 for measuring a pressure of the mixed refrigerant.

Figure 6:
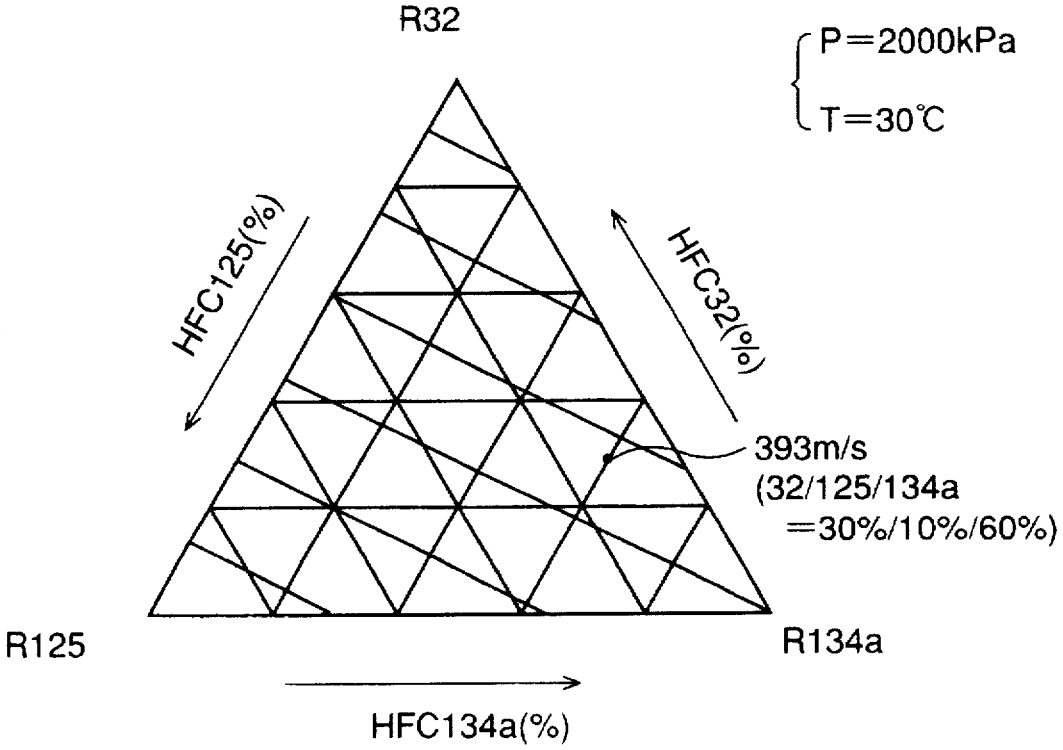
FIG. 6 is a diagram showing the schematic representation of a program contained in a refrigerant density detector.

The refrigerant density detector 8 contains a microcomputer 12 having programmed data on the relationship among sonic velocity, temperature, and pressure as shown in a diagram of FIG. 6. The microcomputer 12 carries out arithmetic operations on inputted measurements of sonic velocity, temperature, and pressure of the mixed refrigerant and displays a density thereof on a display unit 13.

Figure 7:
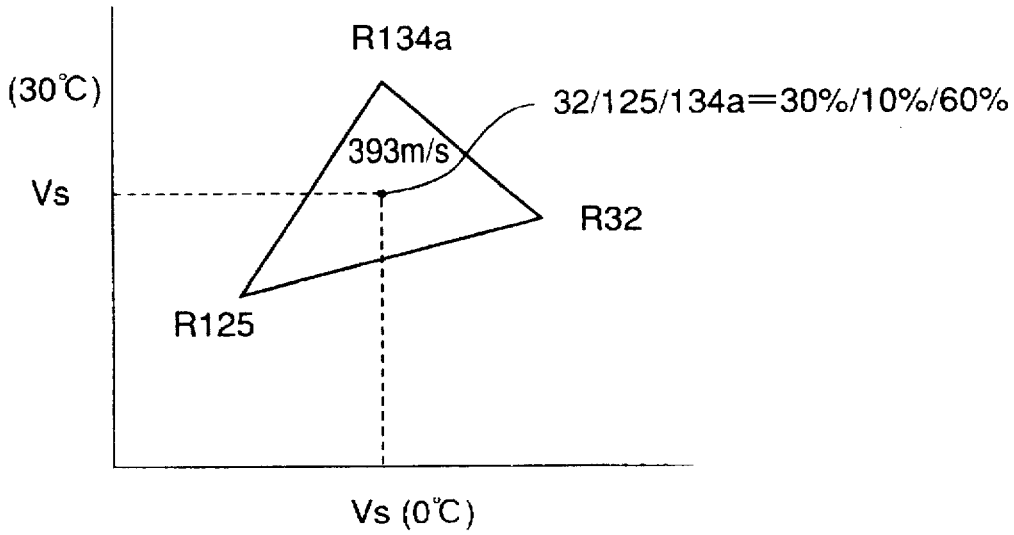
FIG. 7 is a diagram showing the schematic representation of a program for application to two temperature zones contained in the refrigerant density detector.

In details, the composition of the refrigerant is initially set to 52 wt % for R134*a*, 23 wt % for R32, and 25 wt % for R125, for example. The composition changes from the initial state due to a refrigerant leak over a long period of operation. In the refrigerant density detector 8 of the present embodiment, the sonic velocity measuring devices 9, 14, the thermometers 10, 15, and the pressure gauges 11, 16 are adapted to measure a sonic velocity, temperature, and pressure of the mixed refrigerant in the liquid zone of the refrigerant circuit at two positions in different temperature zones. Also, a current density of the mixed refrigerant in the refrigerant circuit is detected by arithmetic operations carried out along the programs, as schematically represented in FIGS. 6 and 7, contained in the microcomputer 12 of the refrigerant density detector 8.

In other words, a bypass piping 21 is cooled by a piping 20 to form two portions having a different temperature in the bypass piping 21. A temperature, a pressure, and a sonic velocity are detected from both of the portions.

For example, as shown in FIG. 6, when measurements in one portion are a pressure of 2000 KPa, a temperature of 30° C., and a sonic velocity of 393 m/s, a straight line passing a point of the sonic velocity 393 m/s is selected. Also, when measurements in another portion are a pressure of 2000 KPa, a temperature of 0° C., and a sonic velocity of 474 m/s, a straight line passing a point of the sonic velocity 474 m/s is selected. As shown in FIG. 7, an intersection point of these straight lines indicates the current proportions of R134*a*, R32, and R125.

Thus obtained proportions of ingredient refrigerants are displayed on the display unit 13 of the refrigerant density detector 8. This tells a change, if any, in the proportion of each ingredient refrigerant from an initial charge.

Reference numeral 34 denotes a refrigerant charge valve provided in the piping of the refrigerant circuit. Reference numerals 38, 39, and 40 denote a plurality of refrigerant tanks of different kinds which are connected to the refrigerant charge valve 34 through control valves 35, 36, 37. The refrigerant tank 38 contains R134*a*, the refrigerant tank 39 contains R32, and the refrigerant tank 40 contains R125.

Reference numeral 19 denotes a controller for controlling the opening and closing of the control valves 35, 36, 37. The controller 19 detects a density of the mixed refrigerant in the refrigerant circuit by means of the refrigerant density detector 8 and controls the opening and closing of the control valves 35, 36, 37 and of the refrigerant charge valve 34 according to a result of the detection, thereby charging the refrigerant circuit with a required kind of refrigerant by a requied quantity from the refrigerant tanks 38, 39, 40.

As a result, even when a mixted refrigerant of R134*a*, R32, and R32 for example is used, the refrigerant density detector 8 can determine which refrigerent has leaked by what quantity. That is, the kind and quantity of a refrigerant to be additionally charged can be automatically determined, and thus identified refrigerant can be automatically added by a required quantity from a relevant refrigerant tank 38, 39, 40. Also, since the kind and quantity of a refrigerant to be additionally charged can be accurately determined, it is possible to adjust the composition of the mixed refrigerant to the one at the initial charge. Thus, a good cooling capability can be maintained.

As a result, a work efficiency of additional charge, maintenance and the like can be improved, and a required cooling performance can be secured.

According to the present embodiment, a refrigerant density is detected in the liquid zone between the outdoor heat exchanger 3 and the capillary tube 4 in the refrigerant circuit. A position of the detection is not limited to this. A refrigerant density may be detected in the gaseous zone between the compressor 1 and the accumulator 7, between the compressor 1 and the four-way valve 2 and the like.

Figure 8:
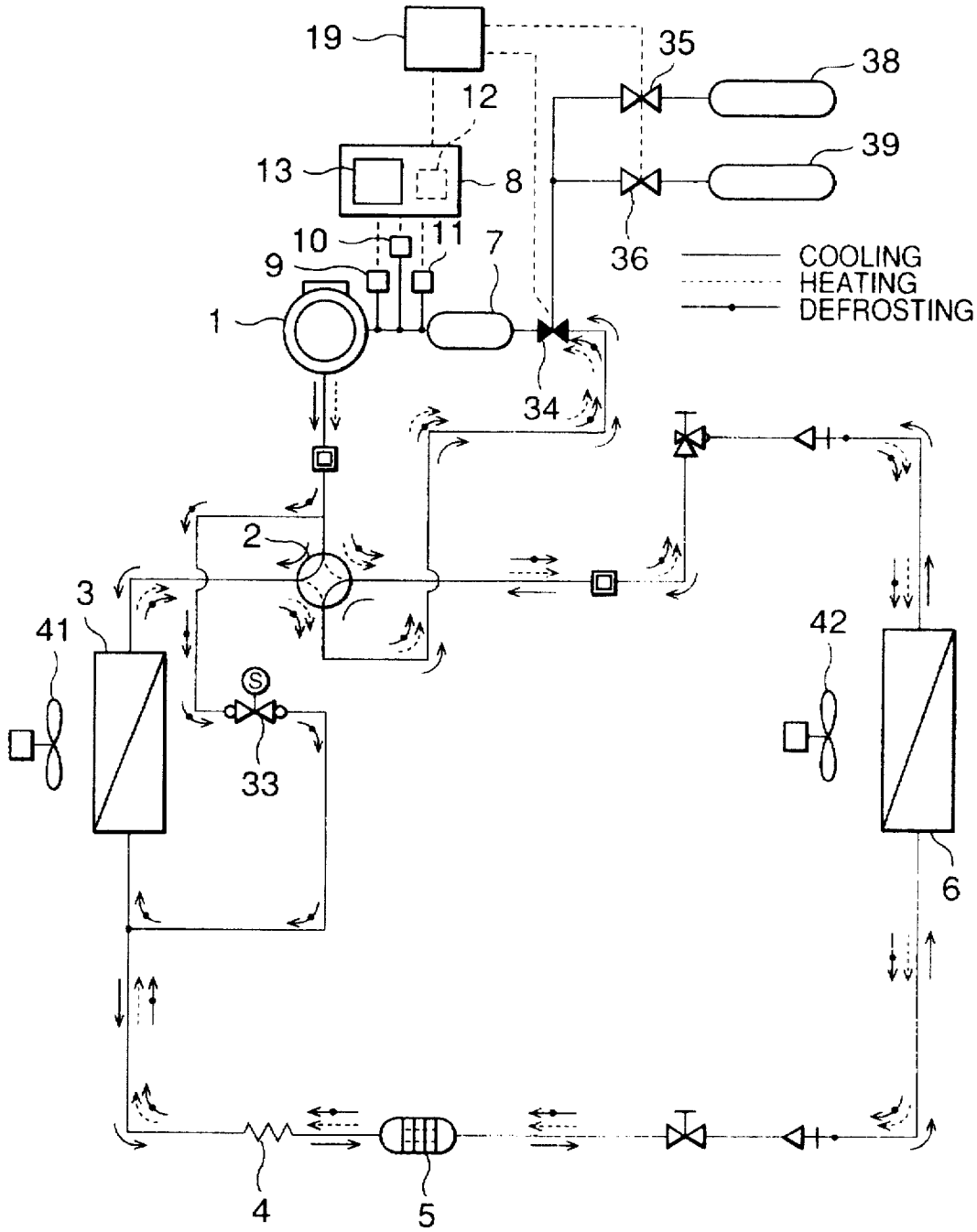
FIG. 8 is a refrigerant circuit diagram of another air conditioner.

FIG. 8 shows a refrigerant circuit of an air-conditioner which is charged with a double mixed refrigerant of R134*a* and R32. In FIG. 8, features denoted by those reference numerals or symbols used in common with FIGS. 1–7 have the same or similar functions as those in the figures.

In this case, the refrigerant density detector 8 is provided between the compressor 1 and the accumulator 7, i.e. a position on the low-pressure side of the refrigerant circuit where a gas refrigerant is rich both in a cooling operation and in a heating operation.

The refrigerant density detector 8 in this case comprises the sonic velocity measuring device 9 for measuring a sonic velocity of the mixed refrigerant of R134*a* and R32 in the gaseous zone by ultrasonic means, the thermometer 10 for measuring a temperature of the mixed refrigerant, and the pressure gauge 11 for measuring a pressure of the mixed refrigerant.

Figure 9:
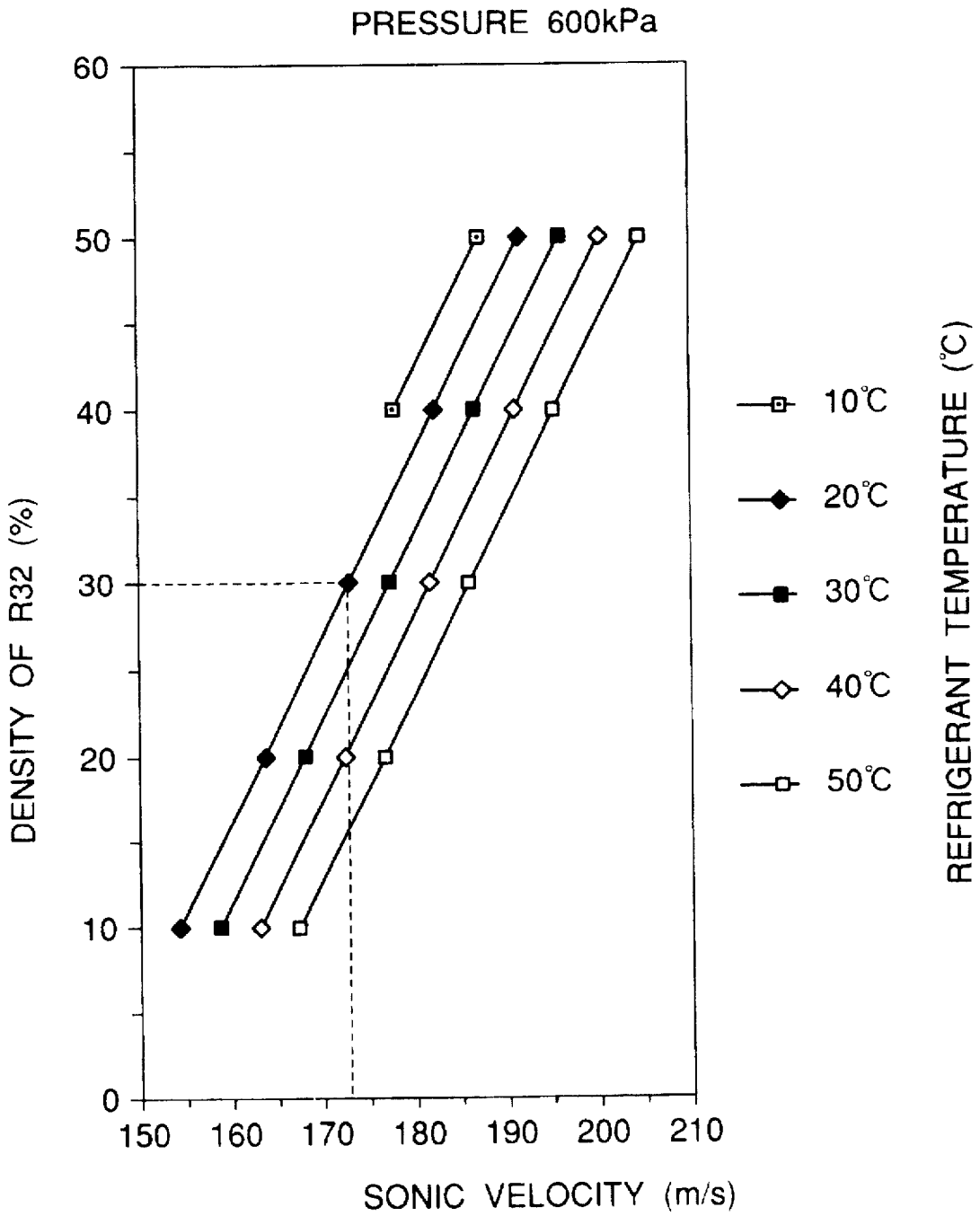
FIG. 9 is a diagram showing the schematic representation of a program contained in a refrigerant density detector of FIG. 8.

The refrigerant density detector 8 contains a microcomputer 12 having programmed data on the relationship between sonic velocity and temperature as shown in a diagram of FIG. 9. The microcomputer 12 carries out arithmetic operations on inputted measurements of sonic velocity, temperature, and pressure of the mixed refrigerant and displays a density thereof on the display unit 13.

In details, the composition of the refrigerant is initially set to 67 wt % for R134*a* and 33 wt % for R32, for example. The composition changes from the initial state due to a refrigerant leak over a long period of operation. In the refrigerant density detector 8 of the present embodiment, a sonic velocity, a temperature, and a pressure of the mixed refrigerant are measured by the sonic velocity measuring device 9, the thermometer 10, and the pressure gauges 11. Also, a current density of the mixed refrigerant in the refrigerant circuit is detected by arithmetic operations carried out along the program, as schematically represented in FIG. 9, contained in the microcomputer 12 of the refrigerant density detector 8.

For example, as indicated by a dashed line in FIG. 9, when a pressure of 600 KPa, a temperature of 20° C., and a sonic velocity of 174 m/s are detected, the proportion of R32 is detected as 30%. Accordingly, the remaining proportion of R134*a* is calculated to be 70%. This tells a change of 3% in composition from an initial charge.

Reference numeral 34 denotes a refrigerant charge valve provided in the piping of the refrigerant circuit. Reference numerals 38 and 39 denote a plurality of refrigerant tanks of different kinds which are connected to the refrigerant charge valve 34 through control valves 35 and 36. The refrigerant tank 38 contains R134*a*, and the refrigerant tank 39 contains R32, as in the previous example.

Reference numeral 19 denotes a controller for controlling the opening and closing of the control valves 35, 36. The controller 19 detects a density of the mixed refrigerant in the refrigerant circuit by means of the refrigerant density detector 8 and controls the opening and closing of the control valves 35 and 36 and of the refrigerant charge valve 34 according to a result of the detection, thereby charging the refrigerant circuit with a required kind of refrigerant by a requied quantity from the refrigerant tanks 38, 39.

As a result, even when a mixted refrigerant of R134*a* and R32 for example is used, the refrigerant density detector 8 can determine which refrigerent has leaked by what quantity. That is, the kind and quantity of a refrigerant to be additionally charged can be automatically determined, and thus identified refrigerant can be automatically added by a required quantity from a relevant refrigerant tank 38, 39. Also, since the kind and quantity of a refrigerant to be additionally charged can be accurately determined, it is possible, as in the previous example, to adjust the composition of the mixed refrigerant to the one at the initial charge. Thus, a good cooling capability can be maintained.

As a result, a work efficiency of additional charge, maintenance and the like can be improved, and a required cooling performance can be secured.

According to the present embodiment, a refrigerant density is detected in the gaseous zone between the compressor 1 and the accumulator 7. A position of the detection is not limited to this. A refrigerant density may be detected on the discharge side of the compressor 1. For detection in a liquid zone, it is preferable that a refrigerant density be detected before the capillary tube 4.

The refrigerant density detector 8 in FIGS. 1 and 8 may be fabricated separately from the air conditioner and may be attached to the piping of the air conditioner by an installation contractor. Also, the refrigerant density detector 8 may be connected through connectors to the pressure and temperature sensors which are already attached to the air conditioner.

On the part of the air conditioner, only the refrigerant charge valve 34 may be provided in the piping of the refrigerant circuit. Charging apparatus to be connected to the refrigerant charge valve 34, such as the control valves 35, 36, 37, the refrigerant tanks 38, 39, 40 and the like, are set on site for charging service by a service contractor.

Furthermore, according to the above-mentioned embodiment, each set S1, S2, S3 of the indoor heat exchanger 6 comprises two parallel conduits 26, 27. However, each set S1, S2, S3 may comprise more parallel conduits. Also, the number of sets is not limited to three, but may be two or more than three for the indoor heat exchanger 6. The above description of the embodiment covers only the state of refrigerant within the indoor heat exchanger 6 in the refrigerant circuit. However, a similar state is also established within the outdoor heat exchanger 3 in the above-mentioned heating operation.

As has been described in detail, according to the present invention, a constituent refrigerant conduit of a heat exchanger is divided into a plurality of sets, each consisting of a plurality of parallel conduits. Parallel conduits of a set are put in communication with each other at ends thereof and in communication, through a single passage, with ends of parallel conduits of another set. Thus, even when a refrigerant flow or a liquid-gas ratio becomes unbalanced among parallel conduits of a certain set, it will be settled as follows. Since refrigerant streams leaving the set join once before entering the next set, an unbalance of a refrigerant flow or the like is settled at the juntion of the streams.

Accordingly, an unbalance of a refrigerant flow or the like is less likely to occur in the heat exchanger as a whole. This allows the heat exchanger to fully exhibit its performance with a resultant improvement of heat exchanging efficiency.

The inner diameter of a passage for putting sets in communication with each other is rendered smaller than that of parallel conduits. Accordingly, a temperature difference can be reduced between the inlet and outlet of the heat exchanger. This makes it possible to suppress or prevent the occurrence of frosting at the inlet when the heat exchanger is used as an evaporator.

What is claimed is:

1. A heat exchanger comprising:

a plurality of heat exchanger sections, each section having at least a pair of refrigerant conduits in parallel;

a plurality of fins for each conduit;

the conduits of each section having an inlet and an outlet end; and a connector having an inlet arm connecting each of the outlet ends of the conduits of one section and an outlet arm connecting to the inlet ends of the conduits of another section in series with the one section, said connector having a common passage connecting its inlet arms to its outlet arms, the refrigerant in one section flowing in parallel through the conduits of the one section and through said common passage of said connector to the next section to flow through the parallel conduits therein, the inner diameter of the common passage of the connector for putting the sections in communication with each other having a smaller inner diameter than that of the refrigerant conduits.

2. A heat exchanger according to claim 1 wherein said heat exchanger is an evaporator.

3. A cooling apparatus in which a refrigerant circuit is formed by connecting a compressor, an outdoor heat exchanger, a pressure reducing device, and an indoor heat exchanger through piping, wherein said indoor heat exchanger and/or outdoor heat exchanger have a plurality of sections, each section having a plurality of parallel refrigerant conduits and a plurality of fins through which said conduits pass, a connector for connecting the ends of said parallel conduits of one section for communication with the ends of the parallel conduits of another section through a single common passage, the inner diameter of the common single passage of the connector for placing sections in communication with each other being smaller than an inner diameter of the refrigerant conduits.

4. A cooling apparatus in which a refrigerant circuit is formed by connecting a compressor, an outdoor heat exchanger, a pressure reducing device, an indoor heat exchanger and the like through piping, wherein said indoor heat exchanger and/or outdoor heat exchanger have a plurality of fins and a refrigerant conduit passing through said plurality of fins, which refrigerant conduit is divided into a plurality of sets, each set comprising a plurality of parallel conduits, said parallel conduits of a set being put in communication with each other at the ends thereof and in communication through a single passage with the ends of the parallel conduits of another set, wherein said refrigerant circuit is charged with a refrigerant prepared by mixing a plurality of ingredient hydrofluoracarbon refrigerants not containing chlorine, said cooling apparatus further comprising:

a refrigerant density detector including a sonic velocity measuring device for measuring a sonic velocity of the mixed refrigerant, a thermometer for measuring a temperature of the mixed refrigerant, and a pressure gauge for measuring a pressure of the mixed refrigerant;

a refrigerant charge portion provided in the piping of said refrigerant circuit;

a plurality of refrigerant tanks of different kinds connected to said refrigerant charge portion through control valves; and a controller for controlling the opening and closing of the control valves, wherein the refrigerant density detector detects a density of the mixed refrigerant in said refrigerant circuit and wherein said controller is adapted to charge said refrigerant circuit with a required kind of refrigerant by a required quantity from said refrigerant tanks according to a result of the detection.

5. A cooling apparatus in which a refrigerant circuit is composed by connecting a compressor, an outdoor heat exchanger, a pressure reducing device, an indoor heat exchanger and the like through piping, wherein said indoor heat exchanger and/or outdoor heat exchanger have a plurality of fins and a refrigerant conduit provided through said plurality of fins, said refrigerant conduit comprises:

a plurality of sets, each set including a plurality of refrigerant conduits arranged in parallel, and a connection conduit which is placed between said sets and is connected to the refrigerant conduits of two sets at the ends thereof and which has a single passage for placing said both sets in communication with each other, wherein said refrigerant circuit is charged with a refrigerant prepared by mixing a plurality of ingredient hydrofluorocarbon refrigerants not containing chlorine, said cooling apparatus further comprising:

a refrigerant density detector including a sonic velocity measuring device for measuring a sonic velocity of the mixed refrigerant, a thermometer for measuring a temperature of the mixed refrigerant, and a pressure gauge for measuring a pressure of the mixed refrigerant;

a refrigerant charge portion provided in the piping of said refrigerant circuit;

a plurality of refrigerant tanks of different kinds connected to said refrigerant charge portion through control valves; and a controller for controlling the opening and closing of the control valves, wherein the refrigerant density detector detects a density of the mixed refrigerant in said refrigerant circuit and wherein said controller is adapted to charge said refrigerant circuit with a required kind of refrigerant by a required quantity from said refrigerant tanks according to a result of the detection.

6. A heat exchanger as in claim 1 wherein each said section has only a pair of refrigerant conduits with the conduits of the pair having a respective inlet end and an outlet end, and said connector has a pair of inlet arms branching from one end of the connector common passage for connection to the respective outlet ends of one said section and a pair of outlet arms extending from the other end of the common passage for connection to the inlet ends of another said section.

* * * * *